United States Patent [19]

Palicka

[11] Patent Number: 4,931,215

[45] Date of Patent: Jun. 5, 1990

[54] DETERGENT COMPOSITIONS CONTAINING A COMBINATION OF A CO-BUILDER AND A BUILDER

[75] Inventor: Jadwiga Palicka, Lidingö , Sweden

[73] Assignee: Berol Nobel AB, Stenungsund, Sweden

[21] Appl. No.: 258,494

[22] Filed: Oct. 17, 1988

[30] Foreign Application Priority Data

Oct. 26, 1987 [SE] Sweden ..... 8704148

[51] Int. Cl.[5] ..... C11D 3/12; C11D 3/33

[52] U.S. Cl. ..... 252/546; 252/174.25

[58] Field of Search ..... 252/527, 546, 174.25

[56] References Cited

U.S. PATENT DOCUMENTS

| | | | |
|---|---|---|---|
| 4,375,422 | 3/1983 | Blackstone | 252/110 |
| 4,769,169 | 9/1988 | Fishlock-Lomax | 252/106 |

FOREIGN PATENT DOCUMENTS

| | | |
|---|---|---|
| 103816 | 9/1978 | Canada . |
| 70191 | 1/1983 | European Pat. Off. . |
| 160507 | 11/1985 | European Pat. Off. . |
| 162600 | 11/1985 | European Pat. Off. . |
| 214868 | 3/1987 | European Pat. Off. . |
| 2125249 | 11/1972 | Fed. Rep. of Germany . |
| 3132767 | 3/1983 | Fed. Rep. of Germany . |
| 58708 | 5/1977 | Japan . |

OTHER PUBLICATIONS

Chemical Abstracts 100 (1984): 70371d.

*Primary Examiner*—Prince E. Willis
*Attorney, Agent, or Firm*—Fred Philpitt

[57] ABSTRACT

Detergent compositions containing a combination of certain amphoteric compounds and zeolites. The amphoteric compounds function as co-builders and the combination gives a very good sequestering ability and thus a low ash content which means good detergency.

11 Claims, No Drawings

DETERGENT COMPOSITIONS CONTAINING A COMBINATION OF A CO-BUILDER AND A BUILDER

The present invention relates to detergent compositions and more particularly to detergent compositions containing a combination of a co-builder and a builder whereby the co-builder consists of certain amphoteric compounds and the builder is based on zeolite. The invention also relates to combinations of amphoteric compounds and zeolites.

Phosphate based detergents were the predominant detergents for several years. Due to the environmental problems connected with phosphate based detergents containing for example sodium and potassium tripolyphosphates, alternatives to these have been tested. Detergents based on nitrilotriacetic acid, sodium citrate and zeolites are nowadays very frequent. Most of these alternative builders do, however, show drawbacks which make it impossible to use them as sole replacements for phosphates. Phosphates in detergents should first of all bind metal ions and also prevent redepositing of dirt on the substrate and they can further also directly contribute to the cleaning effect which is obtained by tensides. While phosphates directly form complexes with polyvalent cations such as calcium, solid zeolites act as ion exchangers. Ions such as calcium are exchanged for the alkali metal ions in the zeolites. For transport of the metal ions to the zeolites auxiliary chemicals, co-builders, such as carboxylates, phosphonates, di- and polycarboxylic acids and salts of these, polyacrylic acids and polyacrylates are used.

There is a need of phosphate-free detergent compositions which in an economical manner give fully satisfactory binding of metals, and then particularly of calcium. The present invention offers such compositions and the compositions according to the invention are based on the fact that it has been found that certain amphoteric compounds in combination with zeolites give a very good total binding of polyvalent metal ions, first of all calcium ions but also iron ions, magnesium ions and others. The amphoteric compounds in the present compositions act in themselves partly as complexing agents for metals but mainly as co-builder for the real builder, the zeolite, and hereby is meant that the amphoteric compound is an auxiliary chemical for zeolites as phosphate replacement products and transports the metal ions to the zeolite.

The present invention thus relates to a detergent composition which comprises a combination of a co-builder which consists of an amphoteric compound having the general formula $$R-(A)_n-[\underset{\underset{B}{|}}{N}-(CHR_1)_x]_y-\underset{\underset{B}{|}}{N}-Q$$

wherein R is a hydrocarbon group having 7 to 22 carbon atoms, A is the group (C(0)) or the group ($OCH_2CH_2$) and n is 0 or 1, $R_1$ is hydrogen or a lower alkyl group, x is 2 or 3, y is an integer of from 0 to 4, Q is the group $-R_2COOM$ wherein $R_2$ is an alkylene group having 1 to 6 carbon atoms and M is hydrogen or an ion from the groups alkali metals, alkaline earth metals, ammonium and substituted ammonium and B is hydrogen or a group Q as defined, and a builder which is a zeolite.

The amphoteric compounds are per se known and used in cleaning compositions and shampoo compositions. They are disclosed in the European patent applications 160507, 162600 and 214868 and according to the latter they are used for their synergistic effect with other surface active compounds and particularly for their antimicrobial properties.

In the amphoteric compounds, which according to the present invention are used as co-builders in combination with zeolites, R is, as said above, a hydrocarbon group having 7 to 22 carbon atoms, suitably 12 to 22, preferably 16 to 22 and most preferably 16 to 18. The hydrocarbon group R can be straight or branched, saturated or unsaturated and optionally contain substituents which do not have a negative effect on the capability of the compounds to form complexes with metal ions or of transporting metals or otherwise a negative effect on the environment where they are used. The group R can also be a cycloalkyl-alkyl group, an aralkyl or aralkenyl group wherein the alkyl or alkenyl part contains at least 6 carbon atoms. It is preferred that R is a hydrocarbon group originating from coconut, tallow or oleic fatty acid. Compounds wherein A is the group ($OCH_2CH_2$) are preferred to those wherein A is a carbonyl group and most preferred are compounds wherein n is 0. $R_1$ is hydrogen or a lower alkyl group, suitably with 1 to 6 carbon atoms and preferably hydrogen or a methyl group. x is 2 or 3 and y is suitably 2, 3 or 4 and preferably 3 or 4. The group $R_2$ is suitably a methylene or ethylene group, preferably a methylene group. M is hydrogen or an ion from the groups alkali metals, alkaline earth metals, ammonium or substituted ammonium such as for example mono-, di- or trihydroxyethyl ammonium. M is preferably a sodium ion. It is of course within the scope of the invention to utilize one or several of the amphoteric compounds of the above given formula as co-builder for zeolite.

The preferred amphoteric compounds can be characterized by the general formula $$R-(\underset{\underset{CH_2COONa}{|}}{N}-CH_2CH_2CH_2)_y-\underset{\underset{CH_2COONa}{|}}{N}-CH_2COONa$$

wherein R and y have the meanings given above.

The zeolites for which the amphoteric compounds work as co-builders are conventional zeolites for use in detergents. Hereby zeoliteNaA is mainly used. The weight ratio of co-builder to builder, i.e. amphoteric compound or compounds to zeolite, should be at least 1:20 and is suitably within the range of from 1:20 to 1:1 and preferably within the range of from 1:10 to 1:1.

The combination of amphoteric compound and zeolite according to the invention is used in per se otherwise conventional detergent compositions which are intended primarily as textile detergents. The detergent compositions can be liquids or be in powder form and they are prepared in a conventional manner, by mixing of the components in water, respectively by spray-drying a slurry of the components, and they are used for laundry in a conventional manner for the respective product type.

In addition to the combination of co-builder and builder the detergent compositions of the invention do of course also contain tensides, and these are preferably nonionic alkoxylated, suitably ethoxylated, compounds such as alkoxylated fatty alcohols, ethoxylated alkylphenols and ethoxylated alkylamines. Anionic tensides, such as soaps, sodium or alkanol amine salts of fatty acids, are often used in detergents. It is preferred that anionic tensides are not present in detergent compositions based on the present combination or that they are present only in small amounts, since it has been noted that there is a negative effect on the detergency effect at higher amounts.

Cationic surface active agents are often used to give a softening effect and they are advantageously present in the detergent compositions and they hereby increase the softening effect obtained from the amphoteric compounds. The freedom of choice with regard to cationic surface active agents is great when the compositions do not contain anionic tensides. As examples of cationic surface active compounds can be mentioned quaternary ammonium compounds such as di-fatty alkyl dialkylammonium chlorides, eg ditallow dimethylammonium chloride, quaternary imidazoline derivatives, such as quaternary salts of ditallow imidazoline methosulphate, salts of long chain amines, primarily tertiary such amines, etc. Other amphoteric compounds than those used according to the invention may of course also be present. Otherwise, per se known components can be present in the compositions such as, for example, water glass for regulation of pH and corrosion inhibition, fillers such as sodium sulphate, carbonates and bicarbonates, bleaching agents such as perborates, percarbonates, bleaching precursors such as TAED (tetracetylethylenediamine), TAGU (tetraacetylglucoluril), diperoxyacids and Caro acid, foam regulators, perfume and coloring agents. The compositions may also contain other, per se known, co-builders for zeolites.

Detergent compositions according to the invention suitably contain the main components given below where amounts of these have been given and are used in proportions to each other to 100 per cent by weight.

Amphoteric compounds: 5–30 per cent by weight
Zeolite: 12–30 per cent by weight
Nonionic tensides: 5–20 per cent by weight
Bleaching agents: 6–20 per cent by weight
Fillers: 20–50 per cent by weight and in these the amphoteric compounds are suitably such mentioned above as preferred and the nonionic tensides are suitably ethoxylated fatty alcohols. The bleaching agent can be a perborate and the filler sodium sulphate.

By combination of amphoteric compound and zeolite according to the invention a phosphate-free detergent composition is obtained which has a very good sequestering ability and thus gives a low ash content, which means a good detergency result. The amphoteric compounds which according to the invention are primarily used as co-builders for the water insoluble zeolites do, of course, also contribute to tenside effect and bactericidal effect and hereby a fully satisfactory detergent composition is obtained.

The invention also relates to combinations of amphoteric compounds and zeolites whereby the amphoteric compounds have the formula given earlier and the weight ratio of amphoteric compound to zeolite is at least 1:20 and suitably within the range of from 1:20 to 1:1.

The invention is further illustrated in the following examples which, however, are not intended to limit the same. Parts and per cent relate to parts by weight and per cent by weight respectively, unless otherwise stated.

EXAMPLE 1

A composition was prepared from the following components:

Water: 14.5%
Triethanolamine: 4.0%
Polyacrylate: 2.0%
Amphoteric compound[1]: 11.0%
Amphoteric compound[2]:2 2.0%
Nonionics[3]: 10.0%
Zeolite (49%): 55.0%
Enzyme: 0.5%

(1) Tallowamphopentacarboxyglycinate
(2) Cocodiiminodipropionate
(3) Mixture of different ethoxylated fatty alcohols The ash content of cotton fabrics after 20 launderings with the compositions was investigated and determined according to the SIS method 872101. The detergent compositions fulfilled the requirements on ash level (1%) and was on the level of 0.2%. Corresponding tests were made without presence of the amphoteric compound in the above formulation and this gave a 20% higher level.

EXAMPLE 2

In this example the calcium sequestering ability of the zeolite and of the combination of amphoteric compound and zeolite was investigated.

100 ml of water with a hardness of 75° dH were mixed with 0.4175 g of zeolite and the mixture was agitated and then filtrated. To 25 ml of the filtrate 15 ml of buffer were then added to a pH of 10. In order to investigate the residual hardness of the water the filtrate was then titrated with EDTA. 16.2 ml of 0.0035 M EDTA were consumed, which means that 148.1 mg of CaO/g had been bound to the zeolite. At a corresponding test wherein 0.21 g of zeolite and 0.02 g of amphoteric compound, tallowamphopentacarboxyglycinate, were used instead of 0,4175 g of zeolite 10.1 ml of EDTA were consumed which means that 290 mg CaO/g had been bound by the combination.

The calcium binding ability of the amphoteric compound alone was also investigated. The test was carried out according to the following: To 100 ml of water having a hardness of 30° dH 0.2 g of the amphoteric compound and 10 ml 2% $Na_2CO_3$ were added. This solution was titrated with 0.25 M calcium acetate until there was an indication that a precipitation had been obtained. The calcium acetate consumption was 1.14 ml which means that 70.2 mg CaO/g had been bound by the amphoteric compound.

I claim:

1. A detergent composition comprising a tenside and a combination of a cobuilder which consists of an amphoteric compound having the general formula $$R-(A)_n-[\underset{\underset{B}{|}}{N}-(CHR_1)_x]_y-\underset{\underset{B}{|}}{N}-Q$$

wherein R is a hydrocarbon group having 7 to 22 carbon atoms, A is the group (C(O))or the group ($OCH_2CH_2$) and n is 0 or 1, $R_1$ is hydrogen or a lower alkyl group, x is 2 or 3, y is 2, 3 or 4, Q is the group —$R_2COOM$ wherein $R_2$ is an alkylene group having 1 to 6 carbon atoms and M is hydrogen or an ion from the groups alkali metals, alkaline earth metals, ammonium and substituted ammonium, and B is hydrogen or a group Q as defined, and a builder which is a zeolite, whereby the weight ratio of amphoteric compound to zeolite is at least 1:20.

2. A composition according to claim 1 wherein the amphoteric compound is a compound wherein R is a hydrocarbon group having 12 to 22 carbon atoms, n is 0), $R_1$ is a hydrogen or a methyl group, x is 2 or 3, y is 3 or 4 and M is a sodium ion.

3. A composition according to claim 1 wherein the amphoteric compound has the general formula $$R-(\underset{\underset{CH_2COONa}{|}}{N}-CH_2CH_2CH_2)_y-\underset{\underset{CH_2COONa}{|}}{N}-CH_2COONa$$

wherein R is a hydrocarbon group having 12 to 22 carbon atoms and y is 3 or 4.

4. A composition according to claim 1 wherein the weight ratio of amphoteric compound to zeolite is within the range of from 1:20 to 1:1.

5. A composition according to claim 2 wherein the weight ratio of amphoteric compound to zeolite is within the range of from 1:20 to 1:1.

6. A composition according to claim 3 wherein the weight ratio of amphoteric compound to zeolite is within the range of from 1:20 to 1:1.

7. A detergent composition comprising as main components from 5 to 30 percent by weight of an amphoteric compound having the general formula $$R-(A)_n-[\underset{\underset{B}{|}}{N}-(CHR_1)_x]_y-\underset{\underset{B}{|}}{N}-Q$$

wherein R is a hydrocarbon group having 7 to 22 carbon atoms, A is the gorup (C(O)) or the gorup ($OCH_2CH_2$) and n is 0 or 1, $R_1$ is hydrogen or a lower alkyl group, x is 2 or 3, y is 2, 3 or 4, Q is the group —$R_2COOM$ wherein $R_2$ is an alkylene group having 1 to 6 carbon atoms and M is hydrogen or an ion from the groups alkali metals, alkaline earth metals, ammonium and substituted ammonium, and B is hydrogen or a group Q as defined, from 12 to 30 percent by weight of zeolite, from 5 to 20 percent of nonionic tensides, from 6 to 20 percent by weight of bleaching agents and from 20 to 50 percent by weight of filler, the main components being used in proportion to each other to 100 percent by weight and the weight ratio between amphoteric compound and zeolite being at least 1:20.

8. A combination of an amphoteric compound and a zeolite characterized in that the amphoteric compound has the general formula $$R-(A)_n-[\underset{\underset{B}{|}}{N}-(CHR_1)_x]_y-\underset{\underset{B}{|}}{N}-Q$$

wherein R is a hydrocarbon group having 7 to 22 carbon atoms, A is the group (C(O)) or the group ($OCH_2CH_2$) and n is 0 or 1, $R_1$ is hydrogen or a lower alkyl group, x is 2 or 3, y is 2, 3 or 4, Q is the group —$R_2COOM$ wherein $R_2$ is an alkylene group having 1 to 6 carbon atoms and M is hydrogen or an ion from the groups alkali metals, alkaline earth metals, ammonium and substituted ammonium, and B is hydrogen or a group Q as defined, and in that the weight ratio of amphoteric compound to zeolite is at least 1:20.

9. A combination according to claim 8

$$R-(\underset{\underset{CH_2COONa}{|}}{N}-CH_2CH_2CH_2)_y-\underset{\underset{CH_2COONa}{|}}{N}-CH_2COONa$$

wherein R is a hydrocarbon group having 12 to 22 carbon atoms and y is 3 or 4.

10. A combination according to claim 8 characterized in that the weight ratio of amphoteric compound to zeolite is within the range of from 1:20 to 1:1.

11. A combination according to claim 9 characterized in that the weight ratio of amphoteric compound to zeolite is within the range of from 1:20 to 1:1.

* * * * *